US006176391B1

(12) United States Patent
Rehkemper et al.

(10) Patent No.: US 6,176,391 B1
(45) Date of Patent: Jan. 23, 2001

(54) MESSAGE PROVIDING CANDY DISPENSER

(75) Inventors: Jeffrey Rehkemper; Daniel Bryce, both of Chicago; Todd Hannon, Burlington, all of IL (US); Joseph Masibay, New York, NY (US); David Richards, Vallejo; Jeffrey R. Annis, Vacaville, both of CA (US)

(73) Assignees: ODDZON, Inc., Pawtucket, RI (US); Rehkemper Invention & Design, Inc., Chicago, IL (US)

( * ) Notice: Under 35 U.S.C. 154(b), the term of this patent shall be extended for 0 days.

(21) Appl. No.: 09/336,959

(22) Filed: Jun. 21, 1999

(51) Int. Cl.[7] ..... G07F 11/00
(52) U.S. Cl. ..... 221/8; 221/266
(58) Field of Search ..... 221/8, 2, 266, 221/263, 196, 271, 275

(56) References Cited

U.S. PATENT DOCUMENTS

| | | | |
|---|---|---|---|
| D. 359,232 | 6/1995 | Diamond et al. | D9/307 |
| D. 375,679 | 11/1996 | Russell | D9/339 |
| D. 386,404 | 11/1997 | Kirk, III et al. | D9/339 |
| D. 388,322 | 12/1997 | Hoeting et al. | D9/415 |
| 790,111 | 5/1905 | Crossley . | |
| 1,354,307 | 9/1920 | Joslin . | |
| 1,725,965 | 8/1929 | Ormiston . | |
| 1,887,389 | 11/1932 | Adams . | |
| 2,117,370 | 5/1938 | Sigg | 312/46 |
| 2,159,356 | 5/1939 | Lambert | 312/76 |
| 2,256,340 | 9/1941 | Gora et al. | 46/124 |
| 2,580,096 | 12/1951 | Holt et al. | 206/56 |
| 3,332,575 * | 7/1967 | Pilot et al. | 221/8 |
| 3,660,930 | 5/1972 | Indjian | 46/117 |
| 4,560,086 | 12/1985 | Stol | 221/198 |
| 4,948,012 | 8/1990 | Snediker, Sr. et al. | 221/195 |
| 4,958,746 | 9/1990 | Wu | 221/24 |
| 4,976,376 | 12/1990 | Williams | 221/24 |
| 5,176,288 | 1/1993 | Craven | 221/124 |
| 5,385,267 | 1/1995 | Diamond et al. | 221/248 |
| 5,540,353 | 7/1996 | Coleman et al. | 221/24 |
| 5,542,570 | 8/1996 | Nottingham et al. | 221/192 |
| 5,603,429 | 2/1997 | Mulhauser et al. | 221/171 |
| 5,651,475 | 7/1997 | Fenton | 221/24 |
| 5,673,813 | 10/1997 | Russell | 221/203 |
| 5,704,789 | 1/1998 | Yang | 434/96 |
| 5,779,095 | 7/1998 | Diamond | 221/263 |
| 5,782,378 | 7/1998 | Hart et al. | 221/24 |

FOREIGN PATENT DOCUMENTS

104641 * 9/1966 (DK) .

OTHER PUBLICATIONS

Cap Candy™ Product Brochure, OddzOn Products, Inc., undated prior art.

* cited by examiner

*Primary Examiner*—David H. Bollinger
(74) *Attorney, Agent, or Firm*—Marshall, O'Toole, Gerstein, Murray & Borun

(57) ABSTRACT

A candy dispenser that provides a message when a piece of candy is dispensed is provided with a housing adapted to hold candy, an actuating member, a candy dispensing mechanism that releases a piece of candy from the housing when the actuating member is moved and a message mechanism having a plurality of different messages associated therewith. The message mechanism includes a spinner that spins from a first radial position to a second and apparently random radial position when the actuating member is moved. The spinner includes visual indicators corresponding to a characteristic of the piece of candy.

18 Claims, 2 Drawing Sheets

MESSAGE PROVIDING CANDY DISPENSER

BACKGROUND OF THE INVENTION

The present invention is directed to a candy dispenser for dispensing candy and providing a message when candy is dispensed.

Various types of candy dispensers have been previously designed. For example, one candy dispenser that was marketed more than one year before the filing of this patent is the Power Candy™ with Skittles® device sold by Cap Candy™ as item number 4755. This device is a hand-held, battery-operated candy dispenser having a motor and a push button switch. When the dispenser contains candy and a customer depresses the push button switch, the motor causes the candy to move in an entertaining manner before a piece of the candy is dispensed to the customer.

Another example of a candy dispenser that was marketed more than one year before the filing of this patent is the Mystical Fortune Gumballs™ device sold by Cap Candy™ as item number 4810. This device is a hand-held candy dispenser that, after being shaken by a customer, dispenses a gumball on which a fortune is written.

SUMMARY OF THE INVENTION

The present invention is directed to a candy dispenser that provides a message when a piece of candy is dispensed from it. The candy dispenser is provided with a housing having a compartment adapted to hold candy and an opening through which a piece of candy may be dispensed, an actuating member extending from within the housing and movable between a first position and a second position, a candy dispensing mechanism disposed within the housing that is adapted to release a piece of candy from the housing when the actuating member is moved between the first position and the second position and a message mechanism. The message mechanism is associated with the housing and has a plurality of different messages associated therewith. The message mechanism facilitates a correlation between one of the messages and a characteristic of one of the pieces of candy.

The message mechanism may include a spinner that spins from a first radial position to a second and apparently random radial position when the lever arm is moved from the first position to the second position.

The message mechanism may also include a message disk having different messages thereon, each of the messages being in physical proximity to each of said visual indicators representations such that when the spinner moves to the second and apparently random radial position and the piece of candy is dispensed, a message may be determined by comparing a characteristic of the piece of candy to the visual indicators on the spinner to determine a matching visual indicator and reading a message in physical proximity to the matching visual indicator.

The features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
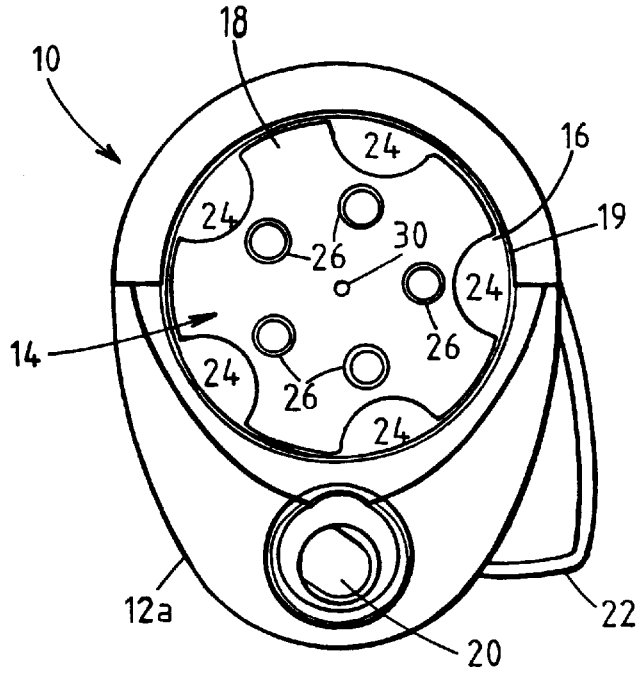
FIG. 1 is a plan view of a preferred embodiment of a candy dispenser in accordance with the present invention.
Figure 2:
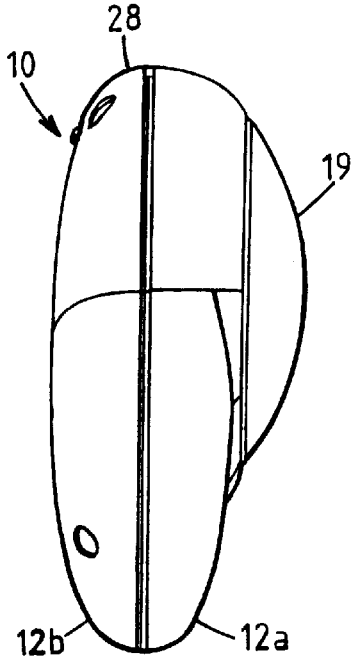
FIG. 2 is a side elevational view of the candy dispenser shown in FIG. 1.
Figure 3:
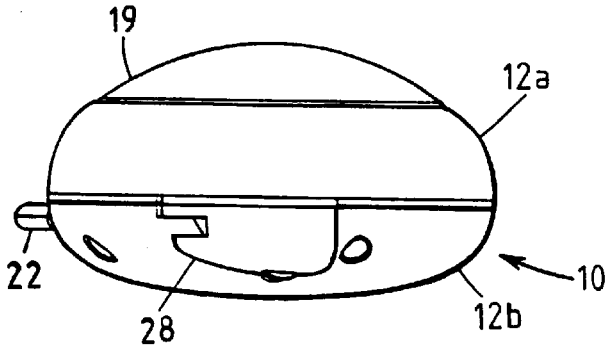
FIG. 3 is an end elevational view of the candy dispenser shown in FIG. 1.

FIGS. 1–4 illustrate a preferred embodiment of a candy dispenser 10 constructed in accordance with the teachings of the present invention. Referring now to FIGS. 1–3, the candy dispenser 10 has a front housing 12*a* and a rear housing 12*b*, which are collectively called a housing 12, containing a message mechanism 14, which includes a label plate 16 and a spinner 18, under a clear dome 19. The candy dispenser 10 further includes an opening 20 in the front housing 12*a* and an actuating member 22, such as a lever arm, extending outwardly from within the housing 12. The label plate 16 includes a number of messages, the positions of which are represented by reference numeral 24, disposed thereon. Although only five message positions 24 can be seen on the label plate 16 shown in FIG. 1, there are actually ten message positions 24 on the label plate 16, five of which are behind the spinner 18. The spinner 18 includes a number of visual indicators 26 that may take the form of colored candy representations.

Prior to operation, the candy dispenser 10 is filled with candy through a dispenser door 28, shown in FIGS. 2 and 3. During operation of the candy dispenser 10, a customer holds the candy dispenser 10 in his or her hand and depresses the actuating member 22. The depression of the actuating member 22 causes the spinner 18 to spin radially about its center 30. Preferably, the spinner 18 has sufficient perimeter weight so that it acts as a flywheel, and remains spinning for some period of time after the actuating member 22 has been depressed and/or depressed and released. While the spinner 18 spins, a piece of candy is dispensed from the housing 12 through the opening 20 so that the customer may access the candy.

The candy that is dispensed from the housing 12 has a characteristic, such as color that corresponds to one of the visual indicators 26 disposed on the spinner 18. When the spinner 18 stops spinning, the customer matches or correlates the characteristic of the dispensed candy to one of the visual indicators 26 and reads a message located in the message position 24 that corresponds to the appropriate visual indicator 26. The spinner 18 may have a play pattern that makes the spinner stop at apparently random radial positions so that the spinner 18 does not always deliver the same message for a particular candy characteristic. Although the play pattern of the candy dispenser 10 may not truly be random, it appears random to the customer and, therefore, is described as apparently random.

In one embodiment, the characteristic of the dispensed candy that correlates to the visual indicators 26 on the spinner 18 is the color of the candy. For example, a candy such as Skittles® has five colors (red, green, yellow, orange and purple) each of which corresponds to a visual indicator 26 on the spinner 18. A customer upon depressing the actuating member 22 and receiving a colored candy, matches the color of the candy to a similarly-colored visual indicator 26 on the spinner 18 and reads a message in a message position 24 corresponding to the similarly-colored visual indicator 26. The messages in the message positions 24 may be fortune messages that may answer questions asked by the customer. For example, messages may include, but are not limited to "YES!", "YEAH BABY!", "DON'T BET ON IT!", "NO!", "IT'S POSSIBLE!", "MAYBE", "HOW SHOULD I KNOW?", "ASK AGAIN LATER", "MOST LIKELY" and "YOU BETCHA!".

The mechanical components of one embodiment of the present invention that make the described operation possible will now be described in detail with reference to FIG. 4. As described previously, the candy dispenser 10 includes the front housing 12*a* and the rear housing housing 12*b*, which collectively form the housing 12. Disposed within the housing 12 is a gear mechanism 32, which includes a sliding combination (combo) gear 34 having a gear portion 36 and a pinion portion 38 and a drive gear 40 that is connected to the actuating member 22, an actuating member spring 42, a center housing 50, the label plate 16, the spinner 18, a spinner spring 54, a floating shim 56, the clear dome 19 and a candy cup 60. Also included within the housing 12 is a spinner shaft 62 that is disposed between the bottom of the spinner 18 and the rear housing 12*b*.

With respect to the materials from which the components of the candy dispenser 10 may be made, the front 12*a*, rear 12*b*, and center housings 50, the label plate 16, the spinner 18, the floating shim 56 and the dispenser door 28 may be manufactured from ABS plastic or any other suitable material. In particular, the front housing 12*a* and the rear housing 12*b* may be fabricated from ABS plastic that is transparent or semi-transparent, which allows the customer to see the inner workings of the candy dispenser 10 and candy stored therein. The gear mechanism 32, including the actuating member 22 having the drive gear 40 thereon and the sliding combo gear 34, may be manufactured from delrin or any other suitable material. The spinner spring 36, the actuating member spring 42 and any screws used in the assembly of the candy dispenser 10 may all be manufactured from steel or any other suitable material.

The candy dispenser 10 is assembled in three steps. First, the center housing 50 and the gear mechanism 32 are installed into the rear housing 12*b* to form a rear assembly. Second, the label plate 16 and the spinner 18, along with the spinner spring 54, the floating shim 56, the clear dome 19 and the candy cup 60 are installed into the front housing 12*a* to form a front assembly. Finally, the front assembly and the rear assembly are snapped and screwed together to complete the candy dispenser 10.

The rear housing 12*b* includes a number of details that are molded into its plastic. Specifically, the rear housing 12*b* includes housing screw bosses 70*a–d*, which accommodate screws 72*a–d* that are threaded through the rear housing 12*b* and into bosses (one of which is shown in FIG. 4 by reference numeral 73) in the front housing 12*a* to hold the front housing 12*a* and the rear housing 12*b* together. The rear housing 12*b* also includes housing screw bosses 70*e–g* that receive screws 72*e–g*, which are threaded through the center housing 50 and into the rear housing 12*b* to attach the center housing 50 to the rear housing 12*b*. Further, the rear housing 12*b* also includes a spinner shaft boss 74 for retaining the spinner shaft 62, a sliding combo gear slot 76, a trigger pivot boss 77, an actuating member guide 78 and a candy guide 84.

The rear assembly is created by fitting the sliding combo gear 34 into the sliding combo gear slot 76, installing the actuating member spring 42 and installing the actuating member 22 into the rear housing 12*b*. The actuating member spring 42 includes hook 86, loop 88 and tail 89 portions and is installed by fitting the hook portion 86 onto the housing screw boss 70*e* and fitting the loop portion 88 onto the trigger pivot boss 77. The actuating member 22 includes a pin 90 that fits into the trigger pivot boss 77 and a slot 92 that fits over the housing screw boss 70*f*. When the actuating member 22 is properly positioned, the drive gear 40 is operatively coupled with the pinion portion 38 of the sliding combo gear 34 and the actuating member 22 rides in the actuating member guide 78. After the actuating member 22 is installed, the tail portion 89 of the actuating member spring 42 is clipped onto the actuating member 22 to urge the actuating member 22 radially outward from the rear housing 12*b* about the pin 90 and the trigger pivot boss 77.

After the actuation member 22, its associated spring 42, and the sliding combo gear 34 are installed onto the rear housing 12*b*, the center housing 50 is installed onto the rear housing 12*b*. Screws 72*e–g* are threaded through the center housing 50 and into housing screw bosses 70*e–g* that are located in the rear housing 12*b*. The screws 72*e–g* fasten the center housing 50 to the rear housing 12*b* and retain all of the components previously installed thereon. The center housing 50 is where candy will be stored when assembly of the candy dispenser 10 is complete. The center housing includes a candy passage 100 over which a piece of candy to be dispensed is located. When the actuating member 22 is depressed, a candy notch 102 in the actuating member 22 aligns with the candy passage 100 and allows the piece of candy to be dispensed down through the candy guide 84 in the rear housing 12*b*, where the user can access the candy. Collectively, the candy passage 100 and the candy notch 102 from a candy dispensing mechanism. When the customer lets go of the actuating member 22, the actuating member spring 42 returns the actuating member 22 to its original position.

The front assembly is created by snapping the candy cup 60 and the clear dome 19 into the front housing 12*a*. The candy cup 60 fits in the opening 20 of the front housing 12*a* and, when the front 12*a* and rear 12*b* housings are fitted together, fits with the candy guide 84 in the rear housing 126. The spinner 18, the spinner spring 54 and the floating shim 56 are installed into the top assembly with the floating shim 56 pressed against the clear dome 19. The label plate 16 is then installed to retain the spinner 18 and in position. The label plate 16 has four screw holes, which are shown in FIG. 4 as 110*a–d*. Screws 111*a–d* are threaded up through the screw holes 110*a–d* and into screw bosses in the front housing 12*a*, two of which are shown in FIG. 4 as reference numerals 112*a* and 112*b*.

Figure 4:
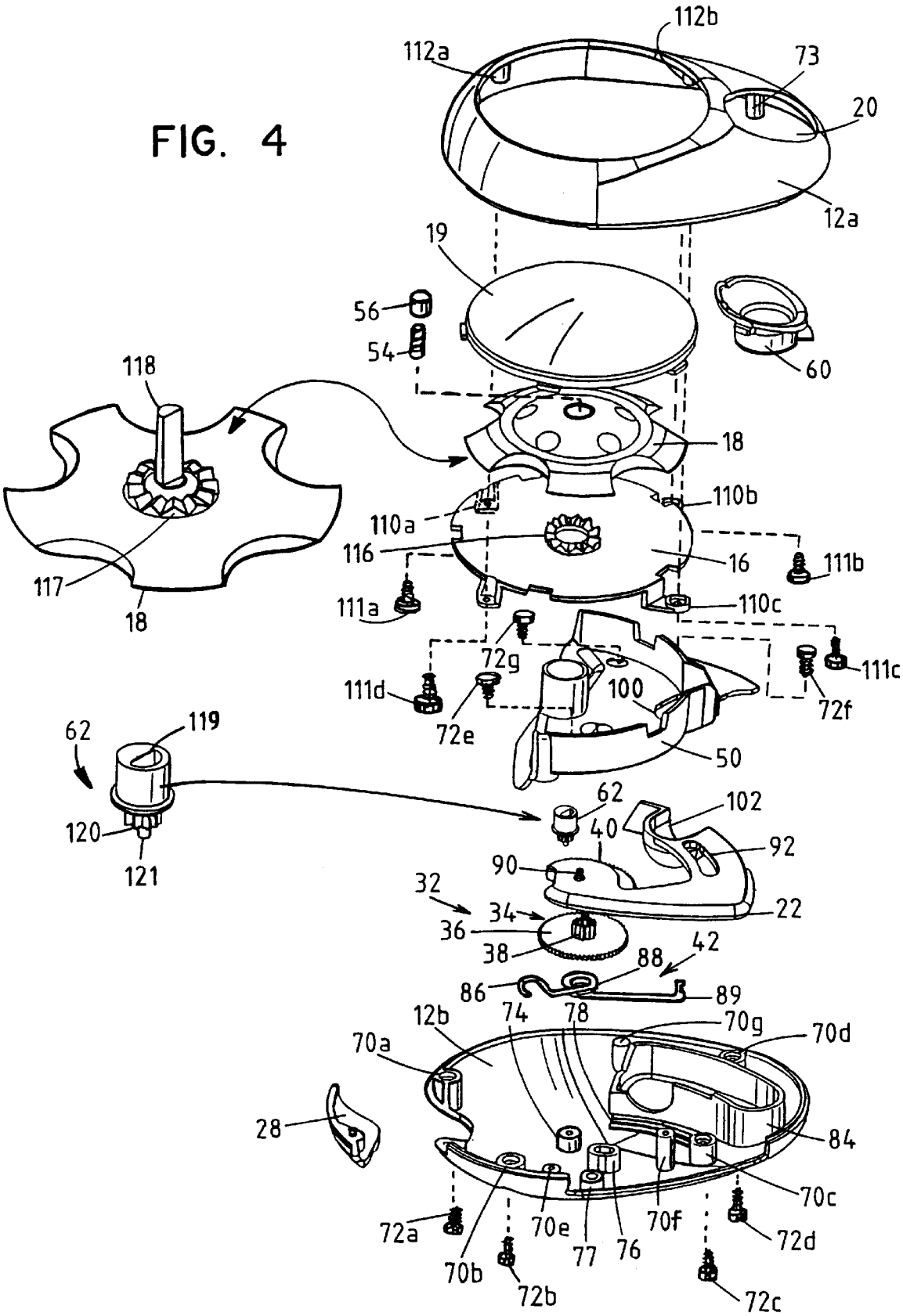
FIG. 4 is an exploded trimetric view of the candy dispenser shown in FIG. 1.

As shown in FIG. 4, the label plate 16 includes a ratchet face 116 disposed about its center hole. The underside of the spinner 18 includes a complimentary ratchet face 117. The two ratchet faces 116, 117 may have ten positions that mate to ensure that the spinner 18 stops at radial positions that enable the customer to read his or her message from one of the message positions 24. The spinner spring 54 and the floating shim 56 provide sufficient force on the ratchet faces 116, 117 to ensure their engagement with one another. The spinner 18 also includes a key 118 that extends from the center of the spinner 18. The key 118 fits into a port 119 in the top of the spinner shaft 62 to couple the spinner 18 and the spinner shaft 62 so that they turn at the same rate. The key 118 slides easily into the port 119 so that the spinner 18 and the spinner shaft 62 may be displaced easily along the axis of the spinner shaft 62. This enables the spinner 18 to ride up and down on the spinner shaft 62 as the ratchet faces 116, 117 interact, while the spinner shaft remains fully engaged in the spinner shaft boss 74. Although the key 118 and the port 119 are shown as having a "D" shape, any shape other than circular is suitable. For example, the key 118 and the port 119 may be square, triangular or oval shaped.

After the top the bottom assemblies are complete, they are fitted together with the spinner shaft 62 extending through the label plate 16 and the center housing 50. The spinner shaft 62 includes a pinion 120 and a pin 122. When the spinner shaft 62 is installed, the pin 122 is seated in the spinner shaft boss 74 of the rear housing 12*b*. At this point, the dispenser door 28 may be installed in place. Screws 72*a–d* are installed through the rear housing 12*b* at housing screw bosses 70*a–d*, to hold the candy dispenser 10 together. When the front assembly and the rear assembly are fastened together, the label plate 16 and the center housing 50 cooperate to form a candy compartment wherein the candy will be stored before it is dispensed.

As previously described, when the actuating member 22 is depressed, candy is dispensed to the customer by the candy dispensing mechanism. Additionally, however, when the actuating member 22 is depressed, the drive gear 40 engages the pinion portion 38 of the sliding combo gear 34 and slides the sliding combo gear 34 into engagement with the pinion 120 on the spinner shaft 62, thereby causing the spinner shaft 62 and the spinner 18 to rotate. After the actuating member 22 has been depressed and the spinner 18 is spinning, the spinner shaft 62 causes the sliding combo gear 34 to disengage from the spinner shaft 62, thereby allowing the spinner 18 to freewheel without mechanical connection to the actuating member 22 or the sliding combo gear 34. While the spinner 18 spins, the ratchet faces 116, 117 interact with one another to ensure that when the spinner 18 stops, it stops at a radial position that will allow the customer to read his or her fortune. When the spinner 18 stops, the customer may correlate the candy dispensed from the candy dispensing mechanism with the visual indicators 26 on the spinner 18 to determine his or her message.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A candy dispenser that provides a fortune message when a colored piece of candy is dispensed, said candy dispenser comprising:

a housing having a candy compartment sided to hold a plurality of pieces of candy and having an opening through which a piece of candy may be dispensed;

a plurality of colored pieces of candy disposed within said candy compartment in said housing said pieces of candy having a plurality of different colors;

a lever arm extending from within said housing and movable between a first position and a second position;

a gear mechanism disposed within said housing and operatively coupled to said lever arm such that when said lever arm is moved between said first position and said second position said gear mechanism operates;

a spinner associated with said housing and operatively coupled to said gear mechanism such that when said gear mechanism operates said spinner rotates from a first radial position to a second and apparently random radial position, said spinner having a plurality of different colored candy representations disposed thereon;

a candy release arm disposed within said housing and operatively coupled to said gear mechanism such that when said gear mechanism operates said candy release arm allows one of said colored piece of candy to be dispensed through said opening in said housing; and a fortune disk associated with said spinner and having a plurality of different fortune messages thereon, each of said fortune messages being associated with one of said different colored candy representations such that when said spinner moves to said second and apparently random radial position and said colored piece of candy is dispensed, a fortune message may be determined by comparing the color of said dispensed piece of candy to said different colored candy representations to determine a matching color candy representation and reading a fortune message associated with said matching color candy representation.

2. A candy dispenser as defined in claim 1 further comprising a candy fill door covering a candy fill opening in said housing.

3. A candy dispenser as defined in claim 1 wherein said different colored candy representations comprise five different colors and wherein said colored pieces of candy comprise five different colors.

4. A candy dispenser as defined in claim 3 wherein said five different colors comprise red, green, yellow, orange and purple.

5. A candy dispenser as defined in claim 1 further comprising a spring that urges said lever arm toward said first position.

6. A candy dispenser as defined in claim 1 further comprising a clear dome over said spinner and said fortune disk.

7. A candy dispenser that provides a fortune message when a colored piece of candy is dispensed, said candy dispenser comprising:

a housing having a candy compartment sized to hold a plurality of pieces of candy and having an opening through which a piece of candy may be dispensed;

a lever arm extending from within said housing and movable between a first position and a second position;

a gear mechanism disposed within said housing and operatively coupled to said lever arm such that when said lever arm is moved between said first position and said second position said gear mechanism operates;

a spinner associated with said housing and operatively coupled to said gear mechanism such that when said gear mechanism operates said spinner rotates from a first radial position to a second and apparently random radial position, said spinner having a plurality of different colored candy representations disposed thereon;

a candy release arm disposed within said housing and operatively coupled to said gear mechanism such that when said gear mechanism operates said candy release arm allows a piece of candy to be dispensed from said housing; and a fortune disk associated with said spinner and having a plurality of different fortune messages thereon, each of said fortune messages being associated with one of said different colored candy representations such that when said spinner moves to said second and apparently random radial position and a piece of candy is dispensed, a fortune message may be determined by comparing the color of said dispensed piece of candy to said different colored candy representations to determine a matching color candy representation and reading a fortune message associated with said matching color candy representation.

8. A candy dispenser as defined in claim 7 wherein said different colored candy representations comprise five different colors.

9. A candy dispenser as defined in claim 8 wherein said five different colors comprise red, green, yellow, orange and purple.

10. A candy dispenser as defined in claim 7 further comprising a spring that urges said lever arm toward said first position.

11. A candy dispenser as defined in claim 7 further comprising a clear dome disposed over said spinner and said fortune disk.

12. A candy dispenser that provides a message when a piece of candy is dispensed comprising:

a housing having a compartment adapted to hold candy and having an opening through which a piece of candy may be dispensed;

an actuating member extending from within said housing and movable between a first position and a second position;

a candy dispensing mechanism disposed within said housing that is adapted to release a piece of candy from said housing when said actuating member is moved between said first position and said second position; and a message mechanism associated with said housing and having a plurality of different messages associated therewith, said message mechanism facilitating a correlation between one of said messages and a characteristic of one of said pieces of candy.

13. A candy dispenser as defined in claim 12 wherein the candy dispensing mechanism comprises a candy release arm that allows a piece of candy to be dispensed through said opening in said housing when said actuating member is moved from said first position to said second position.

14. A candy dispenser as defined in claim 12 wherein the message mechanism comprises a spinner that spins from a first radial position to a second and apparently random radial position when said actuating member is moved from said first position to said second position.

15. A candy dispenser as defined in claim 14 wherein the spinner comprises visual indicators corresponding to a characteristic of the piece of candy.

16. A candy dispenser as defined in claim 15 wherein the message mechanism further comprises a message disk having different messages thereon, each of said messages being in physical proximity to each of said visual indicators representations such that when said spinner moves to said second and apparently random radial position and said piece of candy is dispensed, a message may be determined by comparing a characteristic of said piece of candy to said visual indicators on said spinner to determine a matching visual indicator and reading a message in physical proximity to said matching visual indicator.

17. A candy dispenser as defined in claim 16 wherein said visual indicators comprise colors.

18. A candy dispenser as defined in claim 16 wherein said characteristic of said piece of candy comprises a color.

* * * * *